United States Patent [19]

Bubik et al.

[11] 3,962,031

[45] June 8, 1976

[54] STOCK INLET FOR A PAPER MACHINE

[75] Inventors: Alfred Bubik; Friedrich Platz, both of Ravensburg, Germany

[73] Assignee: Escher Wyss G.m.b.H., Ravensburg, Germany

[22] Filed: Aug. 23, 1974

[21] Appl. No.: 500,066

[30] Foreign Application Priority Data

Aug. 29, 1973 Switzerland ..... 12362/73

[52] U.S. Cl. ..... 162/338; 162/343

[51] Int. Cl.[2] ..... D21F 1/06

[58] Field of Search ..... 162/336, 338, 343, 212, 162/216

[56] References Cited

UNITED STATES PATENTS

| | | | |
|---|---|---|---|
| 3,316,144 | 4/1967 | Knowles | 162/343 |
| 3,471,368 | 10/1969 | Reitzel | 162/338 |
| 3,535,203 | 10/1970 | Nilsson | 162/343 |
| 3,591,452 | 7/1971 | Nykopp | 162/343 |
| 3,843,470 | 10/1974 | Betley et al. | 162/343 |

*Primary Examiner*—S. Leon Bashore
*Assistant Examiner*—Marc L. Caroff
*Attorney, Agent, or Firm*—Kenyon & Kenyon Reilly Carr & Chapin

[57] ABSTRACT

The inlet side of the guiding arrangement in a paper machine is formed with bosses each of which is located adjacent the inlet of a distributor passage to which a stock flow is delivered obliquely. The bosses serve to establish an eddy flow in the region of each inlet so that the stock flows into each inlet substantially radially inwardly of the passage axis. Each boss is sized with a maximum height adjacent an inlet and a breadth of substantially the breadth of the inlet.

14 Claims, 12 Drawing Figures

STOCK INLET FOR A PAPER MACHINE

This invention relates to a stock inlet for a paper machine.

Heretofore, stock inlets for paper machines have frequently used guide arrangements for uniformly distributing stock over the width of the machine so that a paper having constant properties can be formed on a screen or wire. Generally, the guiding arrangement has been in the form of either a simple perforated plate having cylindrical bores extending therethrough or a plate in which passages or ducts, for example of widened steplike form, are formed. Usually, these guiding arrangements have been supplied with stock which is delivered obliquely.

The disadvantage which exists with these previous guiding arrangements for stock inlets which receive obliquely delivered flows of stock is that fibers are able to be retained and accumulate on that rim of the entry openings of the passages or ducts which are downstream relative to the delivered flow of stock. The lumps which are thus formed from the accumulated fibers can lead to disruptions in the paper formation. In fact, damming points can form on the downstream edges or rims of the passages and cause the stock flow to become divided in that region. As a consequence, one part flows into the corresponding duct or passage, but the other part flows into the next passage. Thus, relatively long fibers or fibers which are twisted with one another can be held at these positions.

Accordingly, it is an object of the invention to provide a stock inlet with a guiding arrangement in which the danger of any stock fibers adhering to the mouths of the distributor passages is avoided.

It is another object of the invention to produce a uniform distribution of delivered stock to the individual passages of a guiding arrangement.

Briefly, the invention provides a stock inlet for a paper machine with a guiding arrangement for receiving an obliquely delivered flow of stock and which has a flat base surface on an inlet side and a plurality of distributor passages or ducts, and with means on and projecting from the base surface adjacent each passage inlet for establishing an eddy flow in the region of each inlet in order to prevent fibers in the stock from adhering to the inlets. The eddy flow serves to cause the stock to move into each inlet substantially radially inwardly to the axis of each passage.

The means for establishing the eddy flows at each inlet is in the form of a cam or boss which projects from the base surface of the guiding arrangement and which extends from a respective inlet in a direction upstream relative to the delivered flow. Each boss has a maximum height adjacent a respective inlet and a breadth at each inlet which is substantially equal to the breadth of the inlet.

In one embodiment, the bosses have a longitudinal sectional form rising rectilinearly from the base surface. Such bosses are easy to manufacture and have favorable properties.

In another embodiment, the bosses each have a sawtooth profile in longitudinal section and ascend from the base surface with at least one steep flank facing downstream relative to the delivered flow. In addition to obtaining a favorable eddy or vortex effect at the position of the flank, a separation plane can be obtained through the flank when the guide arrangements are assembled.

In another embodiment, each boss terminates in a point at an end remote from a respective inlet. The boss may also have an end remote from an inlet of a breadth equal at most to the breadth of the boss at the inlet. Which of these two forms is more advantageous for a specific case can best of all be established by experimentation.

In still other embodiments, each boss may have a triangular cross-section and a triangular profile longitudinally thereof; a quadrangular cross-section and a quadrangular profile longitudinally thereof; or a curved cross-section and a curved longitudinal profile.

These are the simplest forms with which the desired result can be produced. However, it is to be understood that also other forms, for example, polygonal forms, or combinations of angular and curved forms, are possible.

Furthermore, the boss can have a terminal surface which extends at a tangent to the inlet of the passage and extends from the base surface at an angle which amounts to at least 90° relative to the upstream side. The bosses constructed in this way are simple and can for example be separately manufactured and fixed on the base surface.

The bosses can, however, also terminate in the region of the passage with a surface which forms an extension of a wall of the passage in question. In certain circumstances, particularly advantageous flow conditions can be obtained with this constructional form, with certain and usually smaller outflow angles.

These and other objects and advantages of the invention will become more apparent from the following detailed description and appended claims taken in conjunction with the accompanying drawings in which:

FIG. 1 diagrammatically illustrates a section of a stock inlet according to the invention with an associated breast roll, over which a screen or wire is guided;

Figure 4:
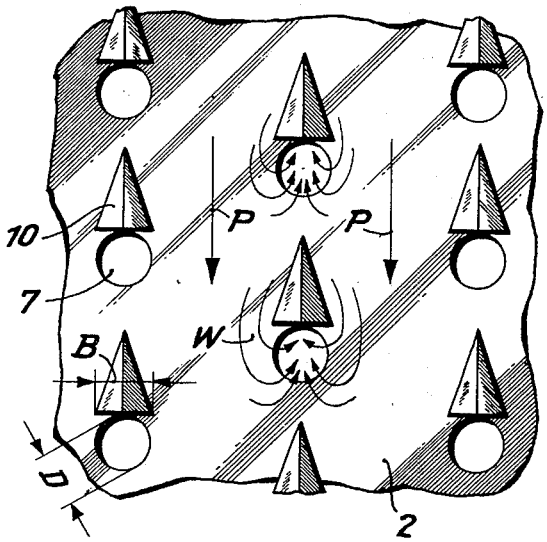
FIG. 4 illustrates an elevational view of the guiding arrangement considered in the direction of the arrow S in FIG. 3.
Figure 11:
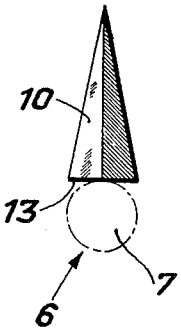
Figure 12:
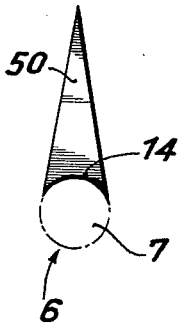

FIGS. 5 to 10 each illustrate different elevations of other constructional forms of bosses according to the invention; and FIGS. 11 and 12 each illustrate elevational views corresponding to FIG. 4 of two forms of bosses.

Figure 1:
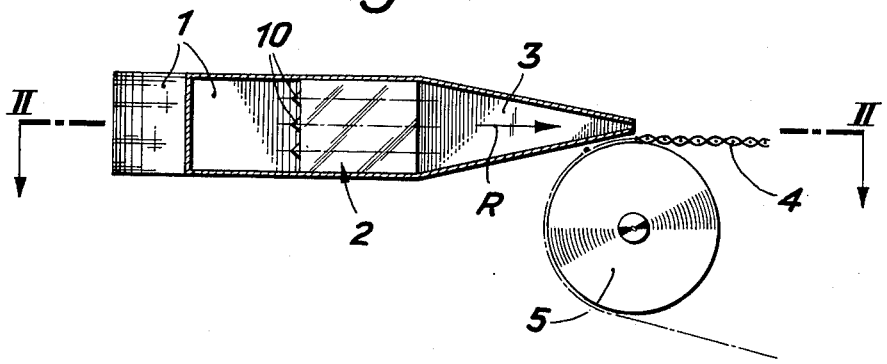
Figure 2:
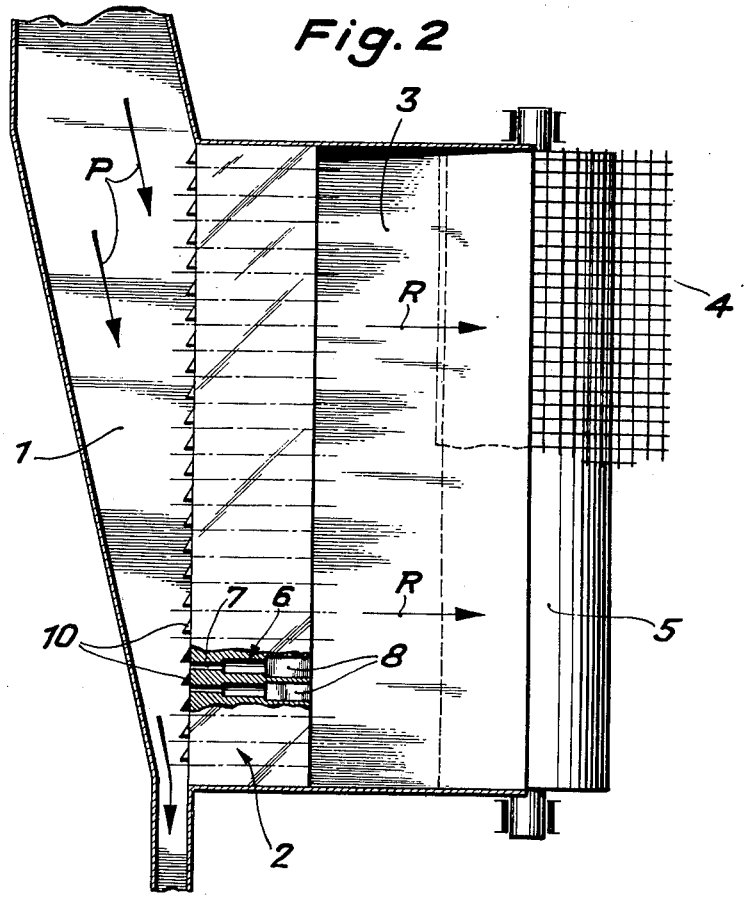
FIG. 2 illustrates a view taken on line II—II of FIG. 1.

Referring to FIGS. 1 and 2, a stock inlet has a distributor box 1, a guiding arrangement, such as a hole plate 2 and a nozzle duct 3. The distributor box 1 serves to deliver a flow of stock at an oblique angle to the guiding arrangement 2. The stock leaving the guiding arrangement 2 flows into the nozzle duct 3 in the direction of the arrows R longitudinally of the wire 4. From the nozzle duct 3 the stock passes on to a wire 4, which is guided over a breast roll 5. As will also be seen from FIG. 2, the guiding arrangement 2 comprises a large number of regularly distributed distributor passages or ducts 6, which are widened in step formation. The passages 6 can, in known manner, have round inlet sections 7 and outlet sections 8 of square cross-section.

Figure 3:
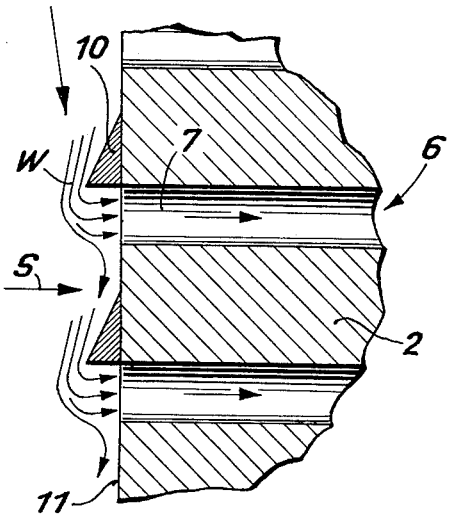
FIG. 3 illustrates a detail of FIG. 2 to a larger scale.

Referring to FIGS. 2 to 4, a means in the form of a boss or cam 10 is positioned at each inlet of a passage 6 to extend from the passage 6 in a direction upstream relative to the flow of delivered stock as represented by the arrows P. As shown in FIGS. 3 and 4, the bosses 10 ascend steadily from a flat exposed base surface 11 of the hole plate 2 and have their maximum height adjoining the inlet to the entry section 7 of the passage 6, this height being represented in FIG. 5 by H. As will also be seen from FIG. 4, the width or breadth B of the boss 10 at the position of maximum height is of substantially the same size as the breadth or the diameter D of the entry section of the passage.

The flows of the stock in the region of the inlets of the entry sections 7 of the passages 6 are represented by arrows W in FIGS. 3 and 4. As will be clear from the path of the arrows, an eddy is set up behind each boss 10, and this has the result that the flow moving around opposite sides of each boss 10 flows substantially radially inwards to the axis of the passage on the entire periphery of the opening. Even under difficult operating conditions, e.g. with long fibers, the inlets of the separate passages remain free from retained fibers and accumulations of fibers.

Referring to FIGS. 5 to 8, various forms of bosses 10, 20, 30, 40 may be used; in each case three elevations of a boss are illustrated, the viewing directions corresponding to the arrows which are shown in the basic elevation. The boss 10 of FIG. 5 has a triangular cross-section and a triangular profile longitudinally thereof taken in the plane of the base surface 11 (not shown). The boss 30 of FIG. 6 has a quadrangular rectangular cross-section taken on a perpendicular to the longitudinal axis and a triangular profile taken longitudinally in the plane of the base surface 11 (not shown). The boss 40 of FIG. 7 has a quadrangular rectangular cross-section as the boss 30 in FIG. 6 and a quadrangular profile taken longitudinally in the plane of the base surface 11 (not shown). The boss 40 of FIG. 8 has a curved semicircular cross-section taken on a perpendicular to the longitudinal axis and a triangular profile taken in the plane of the base surface 11 (not shown). The bosses 10, 20, 30, 40 each have an end surface adjacent an inlet which is at a right angle to the base surface.

Figure 9:
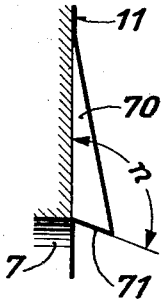
Figure 8:
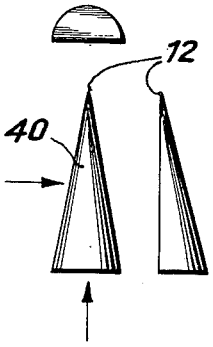

Referring to FIG. 9, the boss 70 terminates in an end surface 71, which forms an angle n with the base surface which is larger than 90°, when measured from the upstream side. As with the boss 10 according to FIG. 4, the surface 71 can be arranged tangentially of the inlet or mouth of the section 7 of the passage 6.

Figure 10:
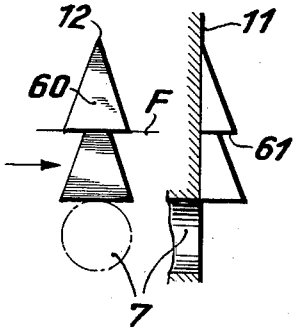

Referring to FIG. 10, the boss 60 may have a saw-tooh profile in longitudinal section which ascends from the base surface 11 and which has at least one steep flank 61 directed downstream. During operation, an advantageous eddy flow is established in the region of the flank 61 which assists an evening out of the distribution of the fibers in the stock. The constructional form according to FIG. 10 is particularly desirable when the guiding arrangement is assembled from several parts, which contain for example individual rows of passages. In this case, the separation surface F between the separate parts can advantageously be used to guide along the flanks 61.

The bosses 10, 20, 40 and 60 which are shown in FIGS. 5, 6, 8 and 10 each terminate in a point 12 at their end remote from the passage 6. The boss 30 according to FIG. 7 has a breadth C at the remote end which is in the base surface 11 and which is, at most, of equal size to its breadth B in the region of the passage.

Referring to FIGS. 11 and 12, the end of each boss adjacent an inlet may be formed in various shapes.

Figure 5:
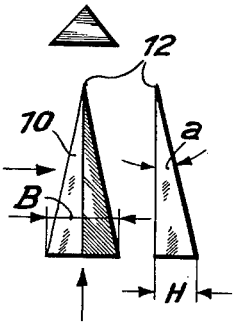
Figure 6:
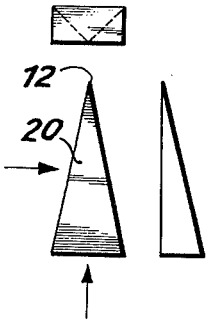
Figure 7:
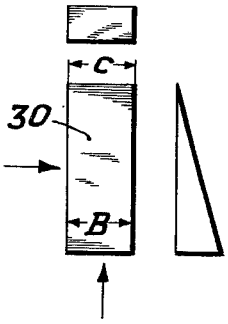

FIG. 11 shows a boss, for example, the boss 10 of FIG. 5, with a plane surface 13 which is perpendicular to the base surface (not shown) and which extends tangentially to the circumference of the inlet or mouth of the section 7 of the passage 6. FIG. 12 shows a boss 50 which ends in the region of the passage 6 with a cylindrical surface 14, which forms an extension of the cylindrical wall of the entry section 7 of the passage 6.

It will be understood that various modifications are possible in the constructional forms which are shown as examples. Thus, experiments have shown that certain deviations between the breadth B of the boss and the breadth or diameter D of the passage 6 at its inlet are possible. The breadth B of the boss can, for example be a certain amount larger or even smaller than the breadth D or the diameter of the mouth. The deviations which are permissible can be up to 10% upwardly or downwardly, without any substantial deterioration in the effect being obtained. Furthermore, the boss does not have to ascend rectilinearly from the base surface, as shown in the examples. Hence, the profile of the boss in the section according to FIG. 3 and in the corresponding elevations in FIGS. 5 to 8 can be a line having convex or concave curvature. In addition, the steepness of the rise of the boss from the plane of the base surface can be different. In tests, satisfactory results were obtained up to an angle *a* of 20° (FIG. 5) with different entry angles of the guiding arrangement which occur in practice. On the other hand, the height H which is also shown in FIG. 5 can also be modified within wide limits. Tests have shown that a satisfactory operation was still possible up to a smallest height H which amounted to half the passage diameter D.

As shown in the drawing, the inlets of the passages on the side of the distributor box 1 are usually circular. However, it will be understood that, in principle, also other shapes of openings, as for example square formations, are conceivable.

It is also possible to visualize different combinations of the elements of the bosses according to FIGS. 5 to 12. Although the bosses according to FIGS. 5 to 11 terminate in flat surfaces in the examples which are illustrated, these surfaces, for example, the surface 71 of FIG. 9, do not necessarily have to be planar. Finally, the surface 14 of the boss according to FIG. 12 can also have a slope such as the slope which the surface 71 has in FIG. 9.

What is claimed is:

1. A stock inlet for a paper machine comprising a hole plate for receiving an obliquely delivered flow of stock, said plate having a flat base surface on an inlet side and a plurality of distributor passages extending therethrough from a respective inlet in said base surface for individual flows of stock; and a plurality of bosses on said inlet side, each boss being disposed adjacent a respective inlet of a passage while projecting from said base surface and extending from said respective inlet in a direction upstream relative to the delivered flow, each boss having a maximum height adjacent a respective inlet and a breadth thereat of substantially the breadth of said respective inlet.

2. A stock inlet as set forth in claim 1 wherein at least some of said bosses each have a longitudinal sectional form rising rectilinearly from said base surface.

3. A stock inlet as set forth in claim 1 wherein at least some of said bosses each have a saw-tooth profile in longitudinal section and ascend from said base surface with at least one steep flank facing downstream relative to the delivered flow.

4. A stock inlet as set forth in claim 1 wherein at least some of said bosses each terminate in a point at an end remote from a respective inlet.

5. A stock inlet as set forth in claim 1 wherein at least some of said bosses each have an end remote from a respective inlet of a breadth equal at most to said breadth at said respective inlet.

6. A stock inlet as set forth in claim 1 wherein at least some of said bosses each have a triangular cross-section longitudinally thereof.

7. A stock inlet as set forth in claim 1 wherein at least some of said bosses each have a quadrangular cross-section taken on a perpendicular to the longitudinal axis thereof.

8. A stock inlet as set forth in claim 1 wherein at least some of said bosses each have a curved cross-section taken on a perpendicular to the longitudinal axis thereof.

9. A stock inlet as set forth in claim 1 wherein at least some of said bosses each have a terminal surface extending tangentially of a respective inlet and extending from said base surface at an angle of at least 90° relative to the upstream side of said respective inlet.

10. A stock inlet as set forth in claim 1 wherein at least some of said bosses each have a terminal surface forming a continuation of a wall of a respective inlet.

11. A stock inlet for a paper machine comprising a hole plate having a flat exposed base surface on an inlet side and a plurality of distributor passages extending therethrough from a respective inlet in said base surface for individual flows of stock;

means for delivering a flow of stock to said inlet side of said hole plate at an oblique angle; and means on and projecting from said base surface adjacent an upstream side of each said inlet relative to a delivered flow of stock for establishing an eddy flow in the region of each inlet whereby the flow of stock moving around opposite sides of each projecting means flows into each inlet substantially radially inwardly to the axis of each passage.

12. A stock inlet as set forth in claim 11 wherein said means on said base surface includes a boss at each passage, each said boss projecting from said base surface and extending from a respective inlet in a direction upstream relative to the delivered flow.

13. A stock inlet as set forth in claim 12 wherein each boss has a maximum height adjacent a respective inlet and a breadth thereat of substantially the breadth of said respective inlet.

14. A stock inlet as set forth in claim 11 wherein said means for delivering a flow of stock is a distributor box disposed on an oblique angle relative to said base surface.

* * * * *